United States Patent [19]

Darroussin et al.

[11] 4,397,589

[45] Aug. 9, 1983

[54] GROUND ANCHORAGE MEANS UTILIZING A REINFORCEMENT OR TIE INSULATED FROM THE GROUND

[75] Inventors: Michel Darroussin, Maisons Laffitte; Daniel Marchand, Paris, both of France

[73] Assignee: Soletanche, Nanterre, France

[21] Appl. No.: 144,588

[22] Filed: Apr. 28, 1980

Related U.S. Application Data

[63] Continuation of Ser. No. 923,989, Jul. 12, 1978, abandoned.

[30] Foreign Application Priority Data

Jul. 13, 1977 [FR] France ..... 77 21650

[51] Int. Cl.[3] ..... E02D 5/76

[52] U.S. Cl. ..... 405/260; 52/155; 405/262

[58] Field of Search ..... 405/259, 260, 262, 269; 52/155, 156

[56] References Cited

U.S. PATENT DOCUMENTS

| | | | |
|---|---|---|---|
| 3,494,134 | 2/1970 | Jorge | 405/260 |
| 3,518,834 | 7/1970 | Gnaedinger et al. | 405/269 |
| 3,753,354 | 8/1973 | Bauer | 405/260 |
| 4,000,623 | 1/1977 | Meardi | 405/260 |
| 4,069,677 | 1/1978 | Yamada et al. | 405/262 X |

FOREIGN PATENT DOCUMENTS

| | | | |
|---|---|---|---|
| 958237 | 11/1974 | Canada | 405/260 |
| 2511863 | 9/1976 | Fed. Rep. of Germany | 405/260 |

*Primary Examiner*—David H. Corbin

*Attorney, Agent, or Firm*—Robert Scobey

[57] ABSTRACT

The ground anchorage means comprises a reinforcement combined with an adjacent injection tube furnished with sleeves acting as retention valves and a distensible sack intended to obturate the drilled hole. The fixing zone of the reinforcement is protected by an impervious envelope made of a rot-proof and anti-corrosive material in which the reinforcement is immersed in a hardenable material such as grouting cement. The free zone is immersed in an anti-corrosive product, which may be flexible in another envelope or sheath, the two envelopes being joined together by a sealing sleeve. Application, particularly for supporting walls.

4 Claims, 3 Drawing Figures

Figure 1:
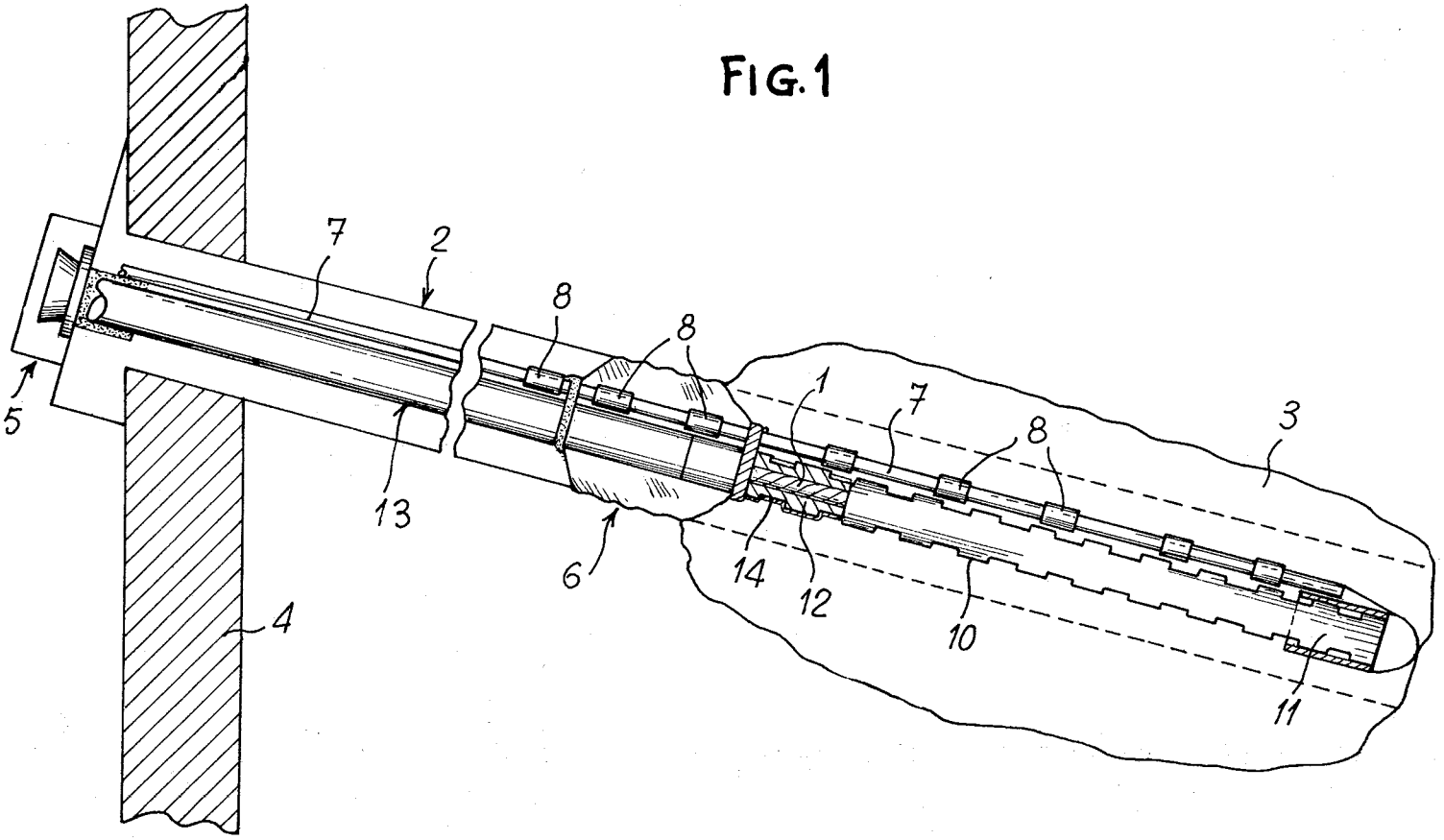

GROUND ANCHORAGE MEANS UTILIZING A REINFORCEMENT OR TIE INSULATED FROM THE GROUND

This is a continuation of application Ser. No. 923,989 filed July 12, 1978, now abandoned.

This invention relates to ground anchorage means, for example in order to support retaining walls, and comprising the combination of a tie-rod forming a reinforcement and an injection tube adjacent the tie-rod, perforated with apertures having retention valves to allow the exit of an injectable grouting material but not the inlet of such material. At least one distensible sack is generally mounted in a sealed manner on a part of the reinforcement and of the tube, at least one opening of this tube being situated in the sack in such a manner that it can be distended by using the said tube.

A device of this type is described in the applicants' French Specification No. 1,539,176, corresponding to U.S. Pat. No. 3,494,134.

To use such means, a hole is drilled in the ground, the anchoring means is introduced into it, the sack is distended by injecting suitable material into it, such as a cement mix, in order to delineate in the drilled hole a sealed fixing area into which is injected hardenable material, such as grouting cement, and subsequently the reinforcement is put under tension thus anchoring the structure to be supported.

The devices which have just been mentioned have a disadvantage in that the bulb formed by the anchoring material is subjected to tension, at least in certain of its parts, which can result in the formation of cracks. If cracks are formed, water can penetrate from the soil into the bulb even to the extent of coming into contact with the reinforcement and corroding it.

The main object of this invention is to prevent this disadvantage.

To this effect, according to the invention, the reinforcement is protected by an impervious envelope of a rot-proof material which is not subject to corrosion, for example a plastics material, in which it is sealed and immersed in a material such as grouting cement, ensuring the transference of forces between the reinforcement and the fixing bulb outside the envelope, the envelope being able to contain, if required, anti-corrosive or insulating products.

In the area of the reinforcement intended to be immersed in the fixing bulb, a zone which is often called the root, the envelope is preferably crenellated, for example by helically winding thereabout a ribbon of suitable section, in such a manner as to ensure good adhesion and, if required, to form, on the interior as well as on the exterior, a thread-like formation which ensures good transference of forces and correct filling of the envelope.

This filling may be facilitated by means for removing water comprising a hollow tip with perforated walls which fits on the envelope and contains a porous mass ensuring the elimination of air and residual water after injection of the internal sealing product. This tip may be left in place or replaced by an impervious cap after fixing.

In the area of the reinforcement outside the fixing zone and which is called the free area, a smooth envelope or sheath is provided which can be furnished internally with an anti-corrosion product which does not hinder free play of the reinforcement, for example a product having a base of pitch and epoxy resin or of grease, a plug and sleeve connecting device ensuring the continuity between the free zone and the fixing zone and the two envelopes being joined together by an impervious sleeve.

Advantageously, the head of the reinforcement is equipped with masking means ensuring electrical insulation and preventing corrosion.

The following description with respect to the accompanying drawings and given as a non-restrictive example, will explain how the invention is carried out, the characteristics emerging from the drawing as well as from the text being, of course, a part of the invention.

Figure 2:
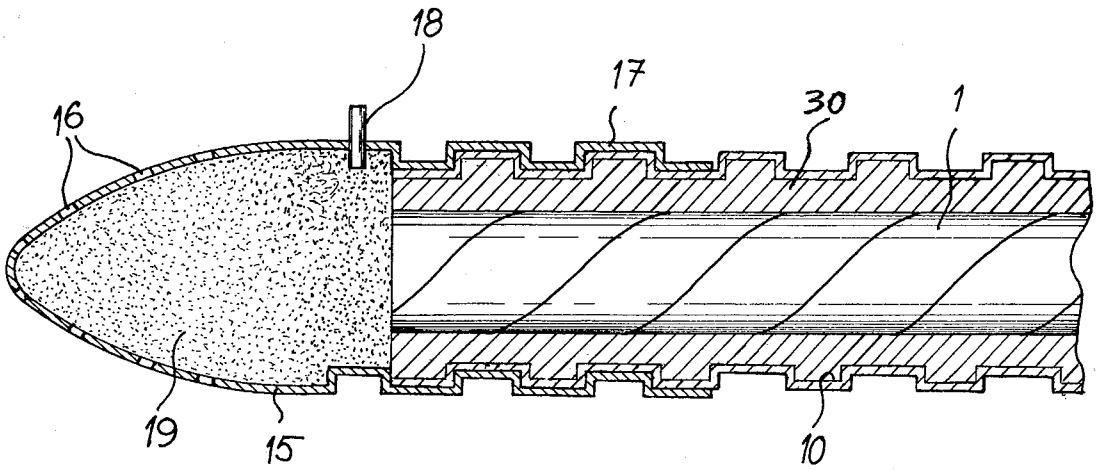
Figure 3:
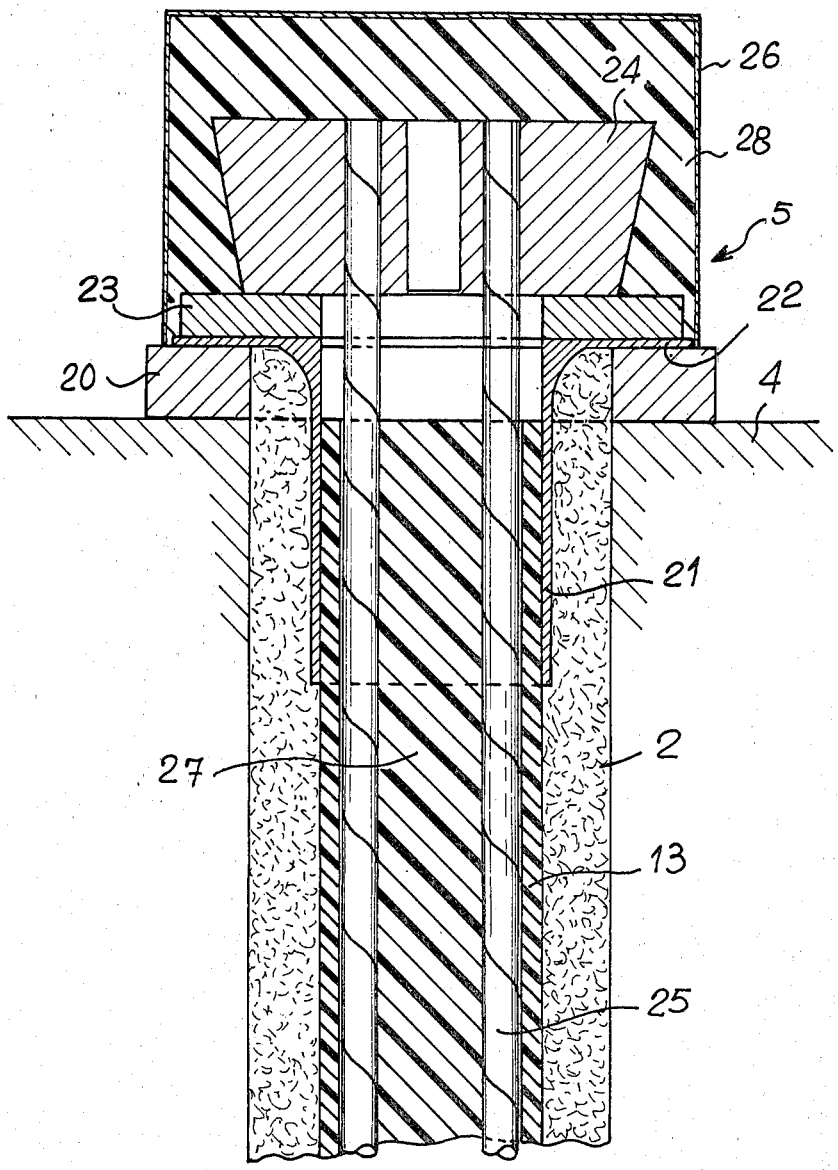

FIG. 1 is a schematic longitudinal section of an anchoring device according to the invention, FIG. 2 is a longitudinal section on a larger scale of the part of the device adjacent the tip, and FIG. 3 is a view similar to the preceding view but relating to the head portion.

In FIG. 1, a complete anchoring device is shown after insertion of a reinforcement 1, sealed in a protective envelope 10, which is positioned in a drilling 2 in the ground and secured by a mass or bulb 3 of grouting cement or other suitable material supporting the reinforcement under tension against a structure 4 to be supported, by means of a suitable system 5 advantageously having electrical and ionic insulation which imparts good insulation to the reinforcement.

The reinforcement comprises a fixing part or zone, otherwise termed the root, and a part or zone which is not fixed, called "free". Between these two parts or zones an obturation sack 6 is situated into which is injected a hardenable material, such as grouting cement, in order to partition off the drilled hole 2 and to delineate the injection zone 3 from the free zone 2, which will be filled with a suitable material according to usual practice.

The injection of the zone 3 and the filling of the obturation sack 6 is carried out by means of a tube 7 which is adjacent the reinforcement 1 and which passes through the sack 6 in a sealed manner. This tube is provided with a plurality of spaced outlet orifices furnished with retention valves comprising sleeves 8 made of rubber or a similar elastomer. The majority of the sleeves 8 are situated in the fixing zone; at least one is provided in the sack 6 and at least one other in the free zone. Injection is accomplished by means of an auxiliary tube (not shown) provided with outlet orifices situated between two obturators which block the tube 7 on either side of the orifices where the injection is to take place. All this is well known in the state of the art and forms the subject, for example, of French Specification No. 986619, published in 1951.

The fixing zone or root of the reinforcement is surrounded and protected by a continuous envelope 10, with a crenellated longitudinal section which can be of helical form, in such a manner that the envelope can be sealed and have inside as well as outside a relief pattern, for example a thread-like formation, ensuring good transmission of forces between the material inside the envelope (material 30) and the material outside the envelope (material 3).

The shape and the dimensions of the crenellations, as well as the thickness of the envelope, are selected so as to avoid unnecessary shearing stresses. In addition, the crenellated shape of the envelope avoids possible loss of adhesion of the fixing material, internally as well as externally, to the material of which the envelope is made.

Furthermore, it is of advantage to use a continuous spiral crenellation, in order to facilitate the circulation of the internal fixing material in the envelope during its injection so as to completely fill the envelope in order to ensure a complete encasement of the reinforcing tie-rod.

The lower free end of the envelope is provided with a drying or water removing device 11 which will be described in greater detail with respect to FIG. 2 and which allows the injection under pressure into the envelope of the internal fixing material, for example, a grouting mortar or cement, which may be the same as the material forming the outer bulb or may be different.

At the other end of the root, the envelope contains a plug 12 which separates the root from the free zone, and through which the reinforcement 1 passes.

This latter zone includes another smooth, flexible and continuous envelope or sheath 13 which passes through the obturation sack 6. This sheath does not adhere to the materials it contains and those which surround it, thus allowing free movement of the reinforcement.

The continuity between the envelope 10 and the sheath 13 is ensured by a sleeve 14 extending about plug 12 consisting of a crenellated portion, which is fitted in a sealing manner to the envelope 10, and a smooth portion which is fitted in a similar manner to the sheath 13 or glued or welded thereto.

FIG. 2 shows the water removing device which consists of an ogival cap or tip 15 pierced with holes 16, integral with a crenellated extension 17 fitted on the envelope 10.

The ogive is provided with a vent 18 permitting the escape of air before forcing the injected material into the envelope 10 around the reinforcement 1; it is lined with a porous material 19.

The water removal device may be left in place or replaced by a sealing cap, after the envelope 10 has been filled with the injected material. This cap is advantageously made of the same material as the envelope 10 and welded thereto in order to ensure continuity of the envelope.

In FIG. 3 can be seen the support system 5 which features a pressure plate 20 resting directly on the structure 4 around the entrance to the drill hole 2. The sheath 13 of the reinforcement is surrounded in a sealing manner by an insulating socket 21 extending into an insulating flange 22 on which rests a plate 23 receiving a member 24 which clamps the tie-rods 25 of the reinforcement. The tie rods extend to the end cap 15, as shown in FIG. 2.

The whole is covered by a cap 26 which insulates it from the outside.

The interior of the sheath 13 is covered with an insulating material 27, preferably flexible and deformable, such as a pitch-epoxy based material, a grease or any other non-corrosive product, or a cement grouting. To this effect, the tie-rods 25 are kept spaced apart, for example by tubular spacers (not shown), so as to permit the passage of an injection tube. After the cap 26 has been put in place a sealing compound 28, preferably similar or identical to the material 27, is injected into this cap.

The anchoring device can very conveniently be manufactured in the factory or in another suitable place before being inserted into the ground, thus considerably facilitating its employment and assuring every safety factor from the point of view of quality.

It is clear that the method of manufacture shown is only an example and that it can be modified, notably by substituting equivalent techniques, without departing from the framework of the invention.

We claim:

1. A ground anchoring device having a root portion adapted to be sealed in the ground, said root portion being comprised of a crenellated envelope with at least one tie rod therein adapted to be encased by a hardenable material, the crenellations of said envelope forming a helical thread to enhance the filling of said envelope with hardenable material and ensure a good transmission of force through said envelope, a free portion joined to said root portion and being comprised of a fluid tight sheath fluid tightly joined to said crenellated envelope and filled with a non-corrosive product, a material injection tube extending outside of and along said sheath and said crenellated envelope substantially over the whole lengths thereof and provided with spaced material injecting outlets for the injection of hardenable material therefrom, a distensible bag in an intermediate zone of said ground anchoring device and fluid-tightly secured at one end thereof to said injection tube and to said sheath and at the other end thereof to said injection tube and to said crenellated envelope, said bag being filled with hardenable material injected therein from said tube, and ground-sealing means for sealing said ground anchoring device at ground level with an anti-corrosion material.

2. A ground anchoring device as in claim 1, in which said ground-sealing means comprises a pressure plate adapted to bear on the structure supported by said ground anchoring device, an insulating material positioned between said pressure plate and said structure, a fluid-tight cap covering said pressure plate and insulating material, said cap being filled with a sealing anti-corrosion material.

3. A ground anchoring device as in claim 1, wherein said envelope is provided at its lowermost end with a draining device that comprises a perforated cap secured at said end of said envelope and lined with a porous material.

4. A ground anchoring device as in claim 3, wherein said perforated cap is removably secured to said envelope so that said perforated cap can be removed after said envelope has been filled with said hardenable material and replaced by a fluid tight cap secured to said envelope.

* * * * *